US010729300B2

(12) United States Patent
Berg et al.

(10) Patent No.: US 10,729,300 B2
(45) Date of Patent: Aug. 4, 2020

(54) FLOOR SURFACING MACHINE

(71) Applicant: HUSQVARNA AB, Huskvarna (SE)

(72) Inventors: Johan Berg, Alingsås (SE); Magnus Rosén, Alingsås (SE); Lars Freidlitz, Västra Frölunda (SE); Pär Madbro, Göteborg (SE); Joakim Leff-Hallstein, Mölndal (SE)

(73) Assignee: HUSQVARNA AB, Huskvarna (SE)

( * ) Notice: Subject to any disclaimer, the term of this patent is extended or adjusted under 35 U.S.C. 154(b) by 2 days.

(21) Appl. No.: 15/513,001

(22) PCT Filed: Jun. 1, 2015

(86) PCT No.: PCT/SE2015/050635

§ 371 (c)(1),
(2) Date: Mar. 21, 2017

(87) PCT Pub. No.: WO2016/048213

PCT Pub. Date: Mar. 31, 2016

(65) Prior Publication Data

US 2017/0238779 A1 Aug. 24, 2017

(30) Foreign Application Priority Data

Sep. 25, 2014 (SE) ..... 14301352

(51) Int. Cl.

| | |
|---|---|
| ***B24B 7/18*** | (2006.01) |
| ***A47L 11/14*** | (2006.01) |
| ***A47L 11/40*** | (2006.01) |

(52) U.S. Cl.

CPC ..... *A47L 11/14* (2013.01); *A47L 11/40* (2013.01); *A47L 11/4008* (2013.01);
(Continued)

(58) Field of Classification Search

CPC . B24B 7/18; B24B 7/186; A47L 11/14; A47L 11/40; A47L 11/4008;
(Continued)

(56) References Cited

U.S. PATENT DOCUMENTS 4,273,384 A * 6/1981 Freeburn ..... E01C 23/0885 172/327
4,709,510 A * 12/1987 Giovanni ..... A47L 11/02 15/98

(Continued)

FOREIGN PATENT DOCUMENTS

CN 86207710 U 6/1987
CN 1402663 A 3/2003

(Continued)

OTHER PUBLICATIONS

International Search Report and Written Opinion for International Application No. PCT/SE2015/050635 dated Feb. 8, 2016, all enclosed pages cited.

(Continued)

*Primary Examiner* — Eileen P Morgan
(74) *Attorney, Agent, or Firm* — Burr & Forman, LLP

(57) ABSTRACT

The present invention relates to a floor surfacing machine (1) comprising a frame (2) that is carried by a first wheel (3) and a second wheel (4). The floor surfacing machine (1) further comprises a first motor (6), a handle arrangement (7), at least one planetary head (15) that is rotatably mounted to the frame (2) and at least one satellite surfacing head (19, 20, 21) that is rotatably mounted to the planetary head (15), where the first motor (6) is arranged to propel the planetary head (15). The floor surfacing machine (1) comprises a first control unit (10), and a remote control panel (11) which in turn comprises a second control unit (12) that is arranged to communicate with the first control unit (10). The floor surfacing machine (1) also comprises a second motor (22)
(Continued)

that is arranged to propel the satellite surfacing heads (19, 20, 21) such that the planetary head (15) and the satellite surfacing heads (19, 20, 21) are independently operable.

12 Claims, 8 Drawing Sheets

(52) U.S. Cl.
CPC ..... *A47L 11/4011* (2013.01); *A47L 11/4038* (2013.01); *A47L 11/4061* (2013.01); *A47L 11/4066* (2013.01); *A47L 11/4069* (2013.01); *A47L 11/4072* (2013.01); *A47L 11/4075* (2013.01); *B24B 7/18* (2013.01); *B24B 7/186* (2013.01)

(58) Field of Classification Search
CPC ..... A47L 11/4011; A47L 11/4038; A47L 11/4061; A47L 11/4066; A47L 11/4069
USPC ..... 451/353
See application file for complete search history.

(56) References Cited

U.S. PATENT DOCUMENTS 4,719,659 A * 1/1988 Urakami ..... A47L 11/16 15/49.1
5,605,493 A * 2/1997 Donatelli ..... A47L 11/305 15/49.1
5,621,291 A * 4/1997 Lee ..... A47L 5/30 180/167
5,622,236 A * 4/1997 Azumi ..... A47L 11/4061 180/168
6,238,277 B1 * 5/2001 Duncan ..... A47L 11/16 451/271
6,315,648 B1 * 11/2001 Neer ..... B24C 3/062 451/75
6,754,979 B2 6/2004 Ludwig et al.
7,140,957 B2 * 11/2006 Thysell ..... B24B 7/186 451/350
7,261,623 B1 * 8/2007 Palushi ..... B24B 7/186 451/350
7,326,106 B1 * 2/2008 Rogers ..... B24B 7/186 15/49.1
7,393,267 B2 * 7/2008 Dummermuth-Furter ..... B24B 41/047 15/49.1
7,563,156 B2 * 7/2009 Anderson ..... B24B 7/186 451/353
8,172,649 B2 * 5/2012 Mann, Jr. ..... B24B 41/047 451/262
D662,523 S * 6/2012 Goentzel ..... D15/124
8,282,445 B2 * 10/2012 Goldberg ..... A47L 11/16 451/350
8,393,937 B2 * 3/2013 Goldberg ..... B24B 7/186 451/350
9,604,341 B2 * 3/2017 Truong ..... B24B 47/12
2005/0054279 A1 * 3/2005 Jordan ..... B24B 7/186 451/350
2006/0026781 A1 * 2/2006 Van Vliet ..... A47L 11/16 15/49.1
2007/0178999 A1 * 8/2007 Wilson ..... B24B 7/186 474/87
2009/0023369 A1 * 1/2009 Thysell ..... B24B 7/186 451/350
2012/0266395 A1 10/2012 Mayer
2013/0292146 A1 11/2013 Fellhauer et al.
2014/0090664 A1 4/2014 Walz et al.

FOREIGN PATENT DOCUMENTS

CN 200963777 Y 10/2007
CN 201077007 Y 6/2008
CN 201143639 Y 11/2008
EP 2110295 A2 10/2009
EP 1492646 B1 9/2010
GB 1360261 A 7/1974
JP S6453355 U 4/1989
JP 2000317803 A 11/2000
JP 2010173027 A 8/2010
JP 2011083839 A 4/2011
NL 1014015 C2 7/2001
WO 0001291 A1 1/2000
WO 03076131 A1 9/2003
WO 2013020160 A1 2/2013

OTHER PUBLICATIONS

Chapter II International Preliminary Report on Patentability for International Application No. PCT/SE2015/050635 dated Nov. 23, 2016, all enclosed pages cited.

* cited by examiner

LEFT

RIGHT

FLOOR SURFACING MACHINE

TECHNICAL FIELD

The present disclosure relates to a floor surfacing machine comprising a frame that is carried by at least a first wheel and a second wheel. The floor surfacing machine comprises a first motor, a handle arrangement, at least one planetary head that is rotatably mounted to the frame and at least one satellite surfacing head that is rotatably mounted to the planetary head, where the first motor is arranged to propel the planetary head. The floor surfacing machine comprises a first control unit and a remote control panel which in turn comprises a second control unit that is arranged to communicate with the first control unit. The floor surfacing machine also comprising a wheel drive assembly for driving said first and said second wheel independently.

BACKGROUND

A floor surfacing machine such as a floor grinding machine is commonly used to strip or smooth flooring by grinding undesired material. A clean, smooth and essentially flat surface to which new coverings or coatings can be applied may be provided.

Floor surfacing machines are also commonly used to smooth a rough flooring surface or remove surface levelling compounds to create a floor which has a smooth, level surface. Certain surfaces, including some types of concrete, are also suitable for polishing using a floor surfacing machine.

One common type of a floor surfacing machine is the planetary-type machine. This type of machine normally comprises two to four, or even more, satellite grinding heads mounted within a larger planetary head, where the satellite grinding heads may be driven in one direction and the planetary head in another direction. A motor, normally an electrical motor, drives both the satellite grinding heads and the planetary head, where transmission is accomplished by means of transmission belts and belt pulleys.

When grinding floor surfaces, an operator normally determines the rate by the time it takes to obtain an acceptable grinding result. This rate is often much slower than a normal walking pace, something that will be uncomfortable and tiring for the person advancing the machine. Advancing a floor surfacing machine at a normal walking pace would require repeated grinding, which may result in an uneven or generally poor result.

Releasing the operator of the floor surfacing machine from the actual propulsion of the machine is previously known from EP 1492646 where a remotely controlled floor surfacing machine is described. The operator is there not required to continuously steer the machine, but can concentrate on monitoring the grinding result and if necessary increase or reduce the rate of advance, removing any obstacles or even controlling more than one floor surfacing machine.

However, for a remotely controlled floor surfacing machine, it is necessary to have a very steady pace without uncontrolled deviations, even for varying frictional forces between the satellite grinding heads and the floor. It is therefore desired to obtain a remotely controlled floor surfacing machine with enhanced control and stability.

SUMMARY

It is an object of the present invention to provide a remotely controlled floor surfacing machine with enhanced control and stability.

Said object is obtained by means of a floor surfacing machine comprising a frame that is carried by at least a first wheel and a second wheel. The floor surfacing machine comprises a first motor, a handle arrangement, at least one planetary head that is rotatably mounted to the frame and at least one satellite surfacing head that is rotatably mounted to the planetary head, where the first motor is arranged to propel the planetary head. The floor surfacing machine comprises a first control unit and a remote control panel which in turn comprises a second control unit that is arranged to communicate with the first control unit. The floor surfacing machine comprises a second motor that is arranged to propel the satellite surfacing heads such that the planetary head and the satellite surfacing heads are independently operable.

According to an example, the floor surfacing machine comprises a handle control panel arranged for control of the operation of the floor surfacing machine. The first control unit may be comprised in the handle control panel.

According to another example, the first motor may be arranged to propel the planetary head by means of at least one cog-wheel that is attached to a second motor axis and is arranged to engage a circumferentially running driving chain arrangement that is attached to the planetary head.

According to another example, the planetary head is arranged to be laterally displaced between a leftmost position and a rightmost position in an oscillating manner.

A number of advantages are provided by means of the present invention, mainly increased stability, control and productivity. Furthermore, having a planetary head and satellite surfacing heads that are independently operable may demand a large force to control for an operator, which is alleviated by means of the present invention where remote control is combined with having a planetary head and satellite surfacing heads that are independently operable.

It is also an object of the present invention to provide a floor surfacing machine for providing a wider surfacing width.

Said object is obtained by means of a floor surfacing machine arranged to laterally displace an operating head between a leftmost and a rightmost position in an oscillating manner.

Said object is also obtained by means of a floor surfacing machine comprising a frame that is carried by at least a first wheel and a second wheel, where the floor surfacing machine further comprises at least one operating head that is rotatably mounted to the frame, and where the floor surfacing machine comprises a control unit, characterized in that the floor surfacing machine comprises a wheel drive assembly for individually controlling the first wheel and the second wheel for laterally displacing the operating head between a leftmost position and a rightmost position in an oscillating manner.

According to one example, the floor surfacing machine comprises a wheel drive assembly for driving said first and said second wheel independently.

In one embodiment the floor surfacing machine is a floor grinding machine.

In one embodiment the floor surfacing machine is a floor cleaning machine.

In one embodiment the floor surfacing machine is a vacuum floor cleaning machine.

A number of advantages are provided by means of the present invention, mainly providing a more even operation and also for providing a wider surfacing path.

BRIEF DESCRIPTION OF THE DRAWINGS

The present invention will now be described more in detail with reference to the appended drawings, where.

DETAILED DESCRIPTION

Figure 1:
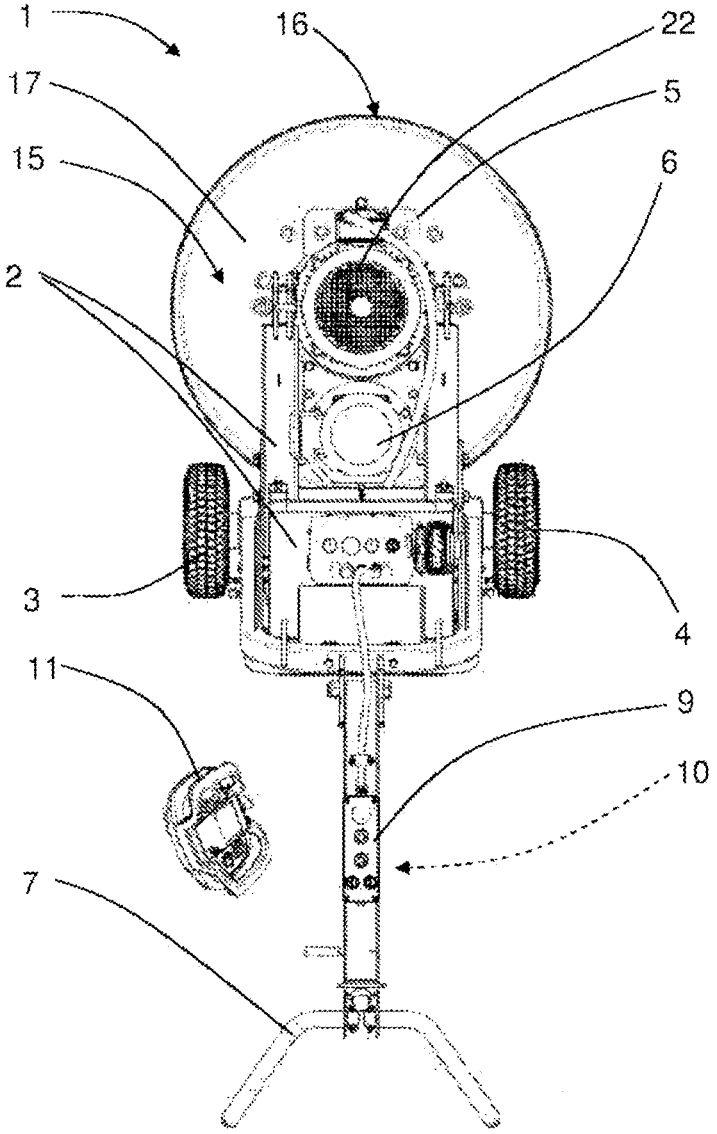
FIG. 1 shows a top view of a floor surfacing machine.
Figure 2:
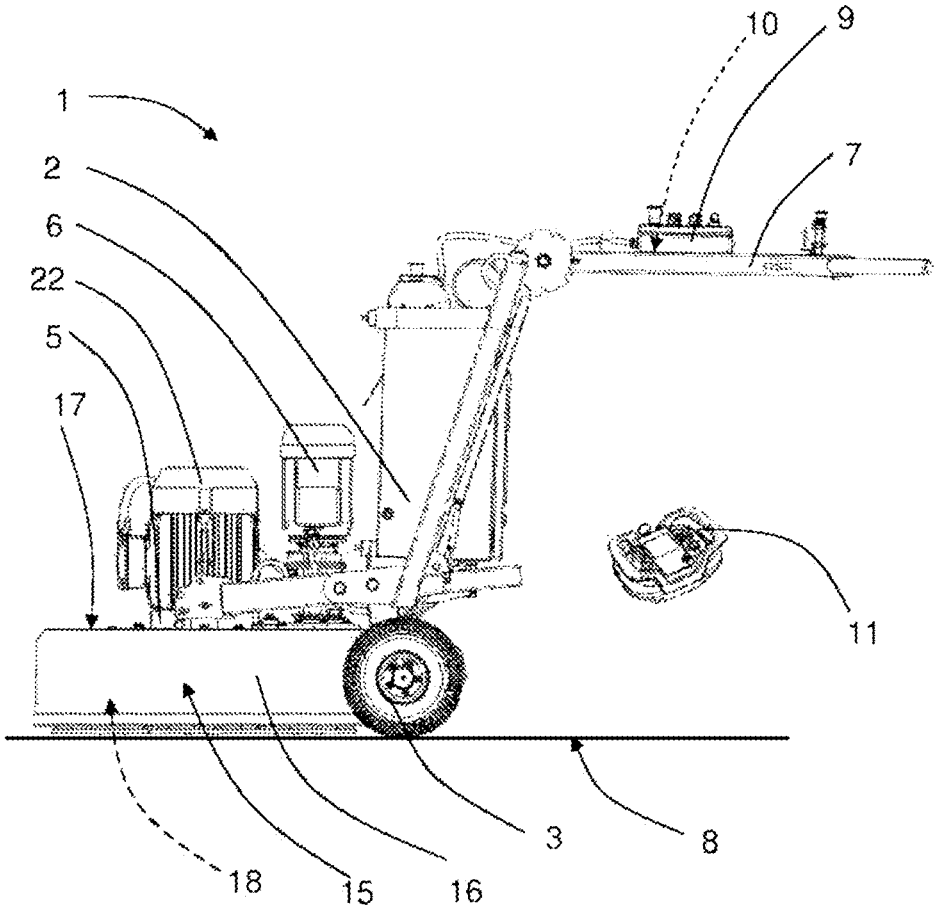
FIG. 2 shows a side view of a floor surfacing machine.

FIG. 1 and FIG. 2 show a top and a side view of a floor surfacing machine 1, for example a floor grinding or polishing machine. The floor surfacing machine 1 has a frame 2 that is carried by a first wheel 3 and a second wheel 4. The frame 2 comprises a motor mounting plate 5 and a handle arrangement 7 allowing an operator to move the machine over a floor surface 8 to be surfaced. The surfacing machine comprises a first motor 6 that is mounted to the frame 2. The handle arrangement 7 may comprise a handle control panel 9 for control of the operation of the floor surfacing machine 1, where the handle control panel 9 in turn comprises a first control unit 10. In one embodiment, the handle control panel 9 is optional. In one embodiment the handle control panel 9 is to be used when the remote control 11 (disclosed below) is failing for some reason for enabling hands-on manual operation of the floor surfacing machine.

In an embodiment where the control panel 9 is missing, the first control unit 10 may be arranged elsewhere, for example adjacent the first motor 6 or any wheel driving motor.

Figure 3:
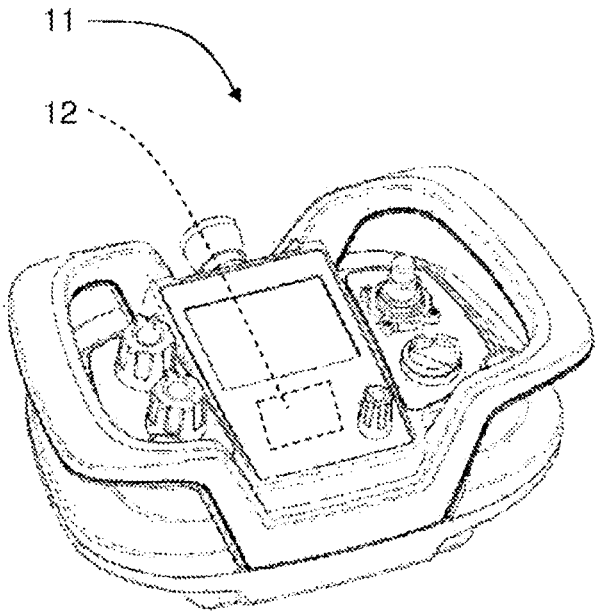
FIG. 3 shows a remote control panel.

With reference also to FIG. 3, the floor surfacing machine 1 further comprises a remote control panel 11 which in turn comprises a second control unit 12 that is arranged to communicate with the first control unit 10 by means of radio signals. The remote control panel corresponds to the handle control panel 9, allowing an operator to remotely run the floor surfacing machine 1.

When remotely controlling the floor surfacing machine 1, an operator should then be positioned having a good, clear view of the floor surfacing machine 1 and floor surface 8 that is to be treated, either by being in the vicinity, or by being at a remote location where the floor surfacing machine and floor surface that is to be treated may be studied via a viewing screen or monitor of some suitable kind. An operator is then not required to continuously steer the floor surfacing machine 1, but can concentrate on monitoring the surfacing result and if necessary increase or reduce the rate of advance, removing any obstacles or even controlling more than one floor surfacing machine.

Whenever appropriate, an operator is naturally able to control and steer the floor surfacing machine 1 by means of the handle control panel 9 and the handle arrangement 7 in the conventional way, manually guiding the floor surfacing machine 1.

It will now be described more in detail which motors and mechanisms that are controlled at the floor surfacing machine 1.

A first wheel drive motor 13 and a second wheel drive motor 14 is mechanically connected to the corresponding first wheel 3 and second wheel 4, and also electrically connected to the to the first control unit 10. The first control unit 10 comprises means for controlling the wheel drive motors 13, 14 individually and hence the direction of rotation and the rotational speed of each wheel 3, 4 as a function of control signals from any one of the control panels 9, 11 which is manually actuated by an operator. In this way, it is possible to steer the floor surfacing machine 1 by means of affecting the wheel drive motors 13, 14 individually, either by means of the handle control panel 9 or the remote control panel 11.

For the purpose of this application, there will be made no difference between whether the first control unit 10 of the control panel 9 or the second control unit 12 of the remote control panel 11 generates the control signals to be provided to the first and second wheel drive motors 13, 14. There will thus, for example, not be made any difference between whether the remote control panel provides wheel drive motor control signals to the first control unit 10 to be forwarded to the wheel drive motors 13, 14 or simply control information regarding control input received via the remote control panel 11 based upon which the first control unit 10 determines wheel drive motor control signals to be sent to the wheel drive motors 13, 14.

For the purpose of this application it will be assumed that all determinations are performed by the first control unit 10, however, as a skilled person would realize, variations regarding which control unit that performs which task should be considered to be part of the invention and as having been performed by the first control unit 10.

The two wheel drive motors 13, 14 are an example of a wheel drive assembly 13,14, where each wheel drive motor drives one respective wheel, thereby providing individual control of each of the first and second wheel 3, 4.

Another example of a wheel drive assembly is having one common motor for driving both wheels, wherein individual control is achieved through an individual gear box (not shown) or individual braking (not shown) of the wheels 3, 4.

The remainder of this application will focus on the wheel drive assembly comprising two wheel drive motors 13, 14, one for each wheel 3,4. A benefit in driving each wheel with its own motor is that a tighter turning radius is achieved, than compared to turning by braking one wheel.

The floor surfacing machine 1 further comprises a planetary head 15 which is rotatably mounted to the frame 2, and comprises a cylindrical wall 16 closed at both ends by a top plate 17 and bottom plate 18, where the motor mounting plate 5 is mounted above the planetary head 15. The first motor 6 is arranged to drive the planetary head 15.

Figure 4:
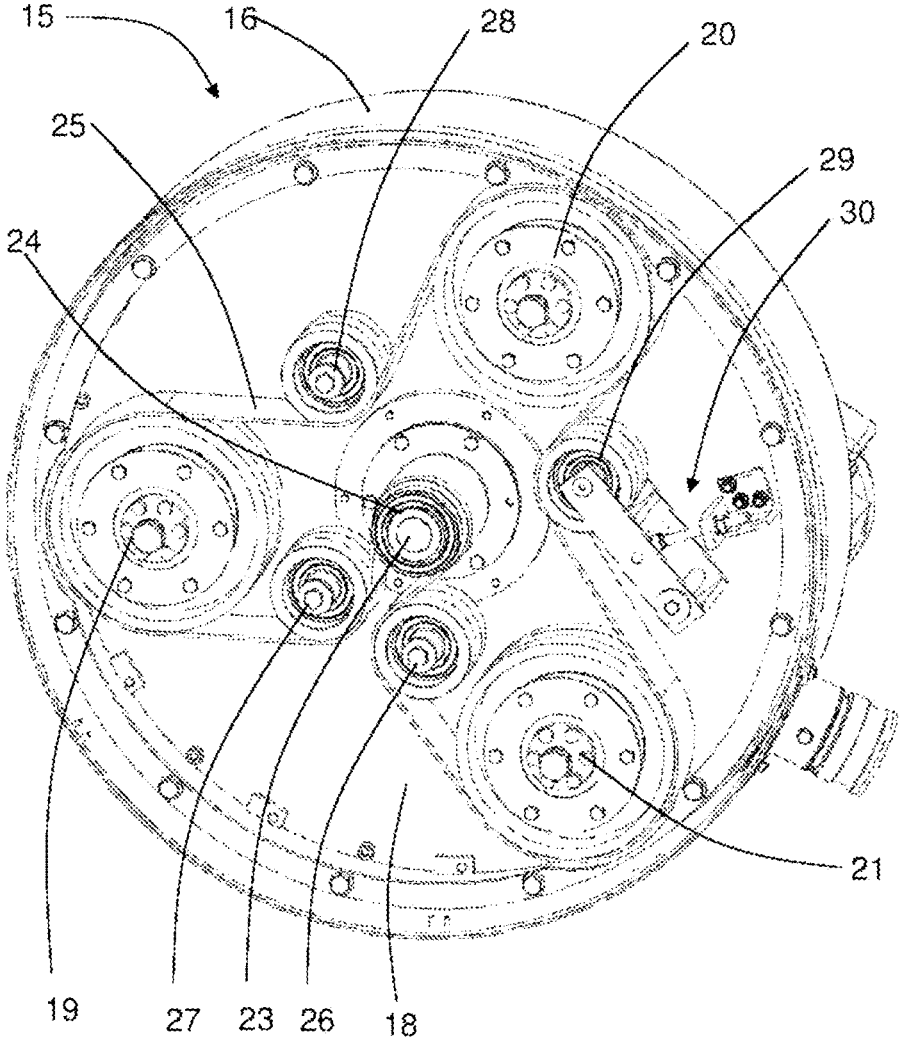
FIG. 4 shows a bottom perspective view of the planetary head.

With reference also to FIG. 4, showing a bottom perspective view of the planetary head 15, the floor surfacing machine further comprises three satellite surfacing heads 19, 20, 21 that are rotatably mounted within the circumference of the planetary head 15, where the satellite surfacing heads 19, 20, 21 are adapted for treating the floor surface 8 by means of for example grinding or polishing. The According to the present invention, the floor surfacing machine 1 further comprises a second motor 22 that is mounted to the motor mounting plate 5, where the second motor 22 is arranged to drive the satellite surfacing heads 19, 20, 21, such that the planetary head 15 and the satellite surfacing heads 19, 20, 21 are independently operable.

The first motor 6 and the second motor 22 operate entirely independently, and as a result, the satellite surfacing heads 19, 20, 21 and planetary head 15 are driven independently, and can be driven in a mutually opposing direction of rotation or in the same direction of rotation, and can be driven at different speeds independently of one another.

Opposite direction of rotation create less friction on the satellite surfacing heads 19, 20, 21, delivering less powerful surfacing effect and easier handling. When the floor surfacing machine 1 is moved forward, a "middle zone" of the surfacing path is ground more thoroughly (twice) than "outer zones" of the surfacing path. The end result is a deeper cut through the "middle zone" and a shallower cut in the "outer zones." It is a direct result of where the satellite surfacing heads 19, 20, 21 have been spending their time.

Having the same direction of rotation creates more friction on the satellite surfacing heads 19, 20, 21, delivering wider width of surfacing effect and higher productivity. When the floor surfacing machine 1 is moved forward, the "middle zone" is still ground more thoroughly than the "outer zones", but not as much as in the case of counter rotation. The end result is still a deeper cut through the "middle zone" when compared to the "outer zones", but it is less pronounced than in counter rotation.

This allows an operator to, for example, drive the planetary head 15 at a relatively low rate over a rough floor surface so that the floor surfacing machine 1 does not bounce when it strikes rough patches but still drive the satellite surfacing heads 19, 20, 21 at relatively high speed so as to maintain production capacity of the floor surfacing machine 1.

If the floor surface 8 is to be only lightly finished, for example polished, the planetary head 15 may be driven quickly so that the floor surfacing machine 1 covers the floor surface 8 at a rapid rate and the satellite surfacing heads 19, 20, 21 remain in contact with any given portion of the floor surface 8 for only a relatively short time. This provides the floor surfacing machine 1 according to the present invention with considerable flexibility in its applications.

The inventors have realized that for a remotely controllable floor surfacing machine 1, it is highly advantageous to have independently driven satellite surfacing heads 19, 20, 21 and planetary head 15 as described above, sine this enables an enhanced control, stability and productivity for a remotely controlled floor surfacing machine 1 compared to prior art.

Furthermore, having a planetary head and satellite surfacing heads that are independently operable may demand a large force to control for an operator, which is alleviated by means of the present invention where remote control is combined with having a planetary head and satellite surfacing heads that are independently operable.

The combination of remote control and independently driven satellite surfacing heads 19, 20, 21 and planetary head 15 thus provides a plurality of advantages.

The second control unit 12 may be arranged to communicate with the first control unit 10 by means of other means than radio signals, for example optical or sonic signals.

Figure 5:
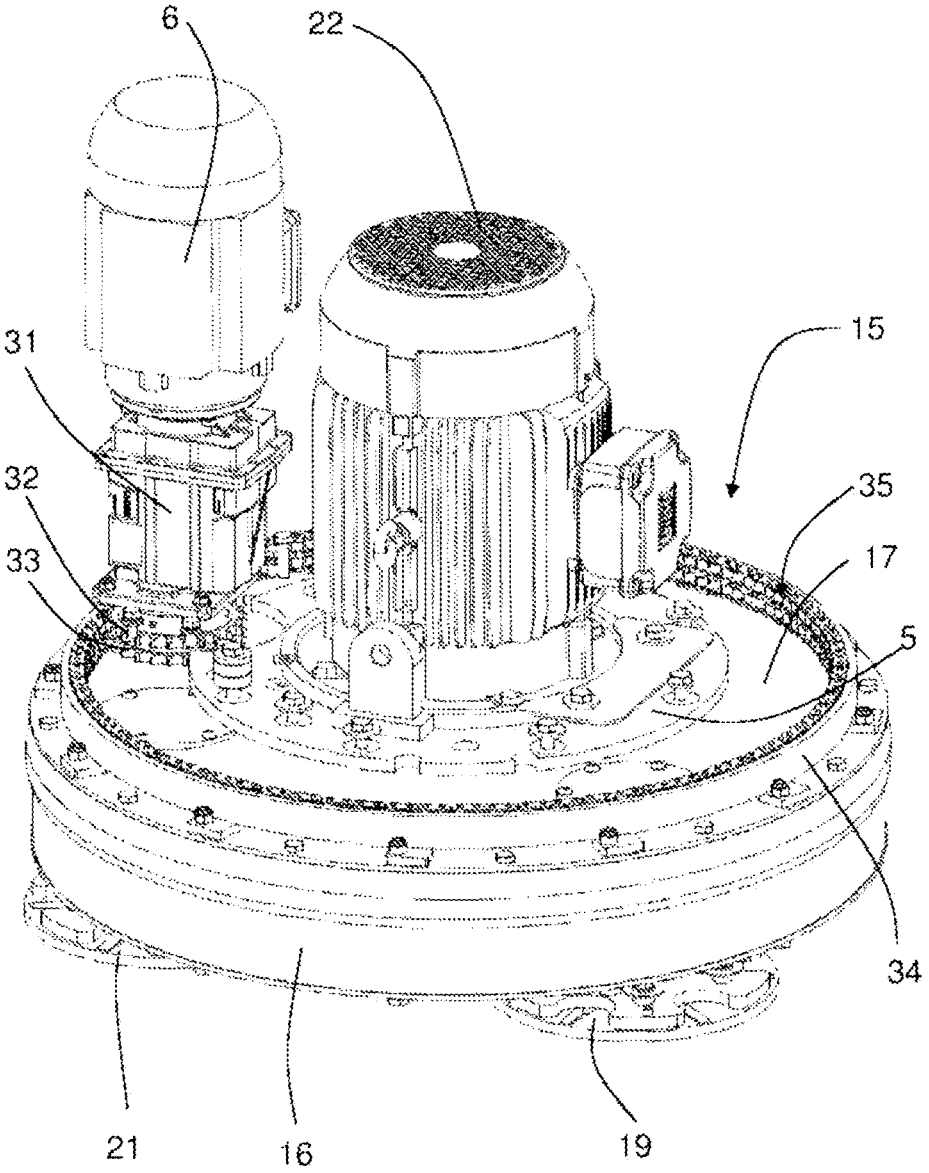
FIG. 5 shows a top perspective view of the planetary head.

In the following, an example of how the planetary head 15 and the satellite surfacing heads 19, 20, 21 are propelled by means of the first motor 6 and the second motor 22 will now be described more in detail with reference to FIG. 4 and FIG. 5, where FIG. 5 shows a perspective top view of the planetary head 15.

With reference to FIG. 4, the second motor 22 (not shown in FIG. 4) is connected to a first motor axis 23 that extends through the top plate 17 and the bottom plate 18, and is connected to a first belt pulley 24 that is arranged to drive an endless belt 25 that further is guided by means of a second belt pulley 26, a third belt pulley 27, a fourth belt pulley 28 and a fifth belt pulley 29. Each of the second belt pulley 26, third belt pulley 27, the fourth belt pulley 28 and the fifth belt pulley 29 is rotatably connected to the bottom plate 18, and is arranged to guide the endless belt 25 around the satellite surfacing heads 19, 20, 21 such that they are propelled when the second motor 22 drives the endless belt 25.

The fifth belt pulley 29 is attached to the bottom plate 18 via tensioning device 30 that is arranged to press the fifth belt pulley 29 against the endless belt 25 with a certain force, for example by means of a spring arrangement (not shown). In the way, the endless belt 25 is tightened around the belt pulleys 24, 26, 27, 28, 29 and the satellite surfacing heads 19, 20, 21 to a certain extent that suitably is adjustable by means of the tensioning device 30. The tensioning device 30 should also be releasable such that the endless belt 25 is untightened, for example if the endless belt 25 needs to be replaced.

As shown in FIG. 5, the first motor 6 is connected to a gear-box 31 from which a second motor axis (not shown) extends. Two driving cog-wheels 32, 33 are attached to the second motor axis. Furthermore, the planetary head 15 comprises a circumferentially running top rim 34 that is mounted to the top plate 17. On the inner side of the rim top 34, a driving chain arrangement 35 is attached. The driving chain arrangement 35 is arranged to engage the driving cog-wheels 32, 33 such that when the driving cog-wheels 32, 33 are propelled by means of the first motor 6, these rotate the chain arrangement 35 which in turn rotate the planetary head 15 to which it is attached via the top rim 34.

The above are only examples of how the planetary head 15 and the satellite surfacing heads 19, 20, 21 are propelled by means of the first motor 6 and the second motor 22, many other types of transmission arrangements are of course conceivable. For example, the first motor 6 may be arranged to propel the planetary head 15 by means of an endless belt that runs around the outer surface of the top rim, where the endless belt is connected to the first motor 6 by means of a pulley transmission arrangement (not shown).

The positions of the first motor 6 and the second motor 22 may be altered in dependence of how they are arranged to propel the planetary head 15 and the satellite surfacing heads 19, 20, 21.

Figure 6:
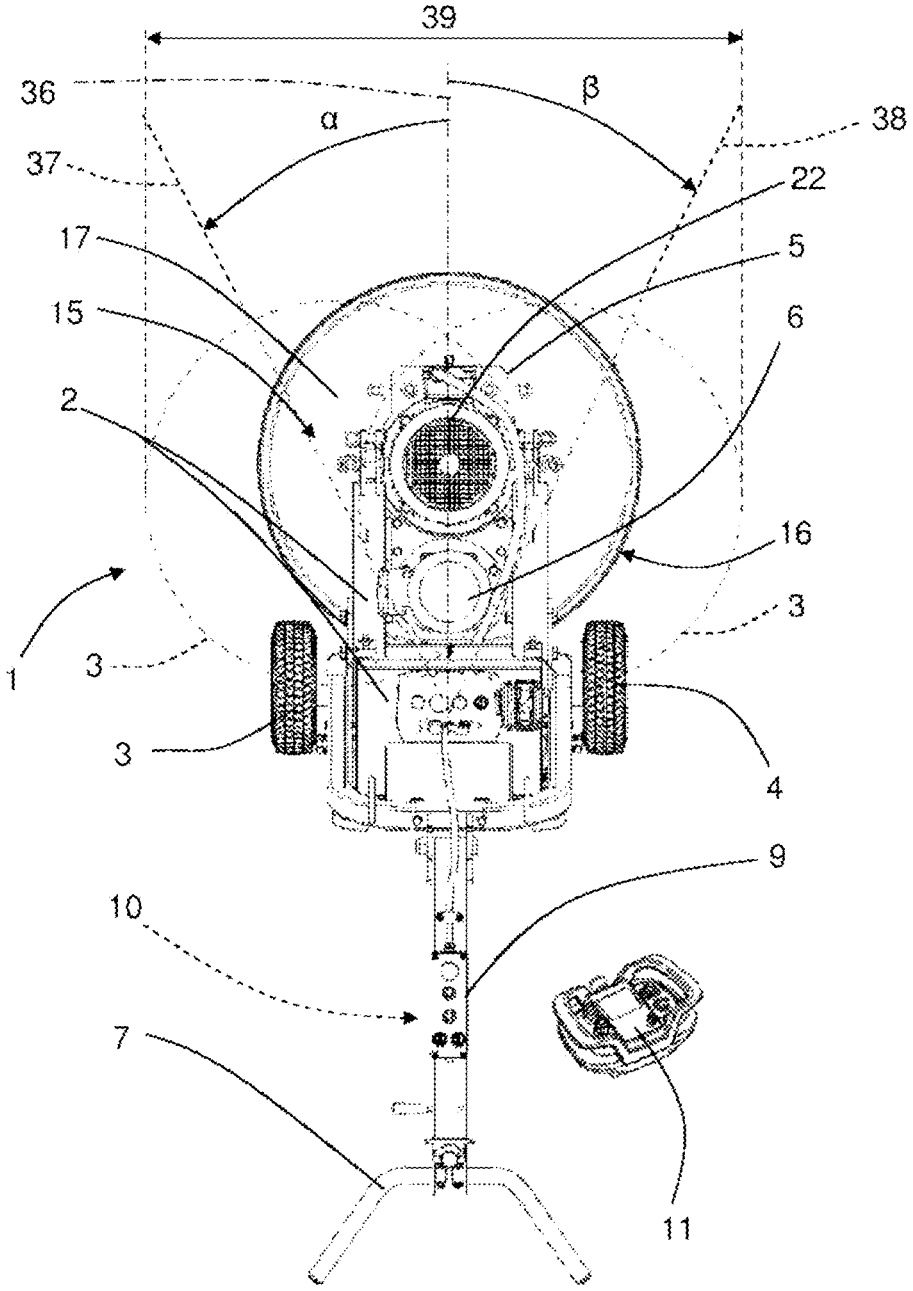
FIG. 6 shows a top view of a floor surfacing machine with an oscillating feature.

With reference to FIG. 6, showing a further example, the floor surfacing machine 1 is equipped with an oscillating feature that widens the surfacing width. The planet head 15 is then arranged to be laterally displaced from a normal position where the center of the planetary head 15 intersects a first line 36 that runs through the surfacing machine in its longitudinal direction. The displacement runs between a leftmost position where a first angle $\alpha$ is formed between the first line 36 and a second line 37 that intersects the center of the planetary head 15, and a rightmost position where a second angle $\beta$ is formed between the first line 36 and a third line 38 that intersects the center of the planetary head 15. The second line 37 and the third line 38 also intersect each other and the first line 36 at a certain point in the floor surfacing machine 1. The planetary head 15 thus cover an area as indicated by the dashed circles 37A and 38A, thereby providing a widened surfacing path 39..

When the planet head 15 oscillates between the leftmost position and rightmost position, an increased surfacing width 39 is obtained. Furthermore, a more lenient surfacing is obtained. If a floor surfacing machine is made to run in parallel (distinct) lines the surface may be unevenly surfaced, where the areas where the center of the planetary head 15 has passed over having received more surfacing than the areas where the sides of the planetary head 15 have passed over.

Figure 7:
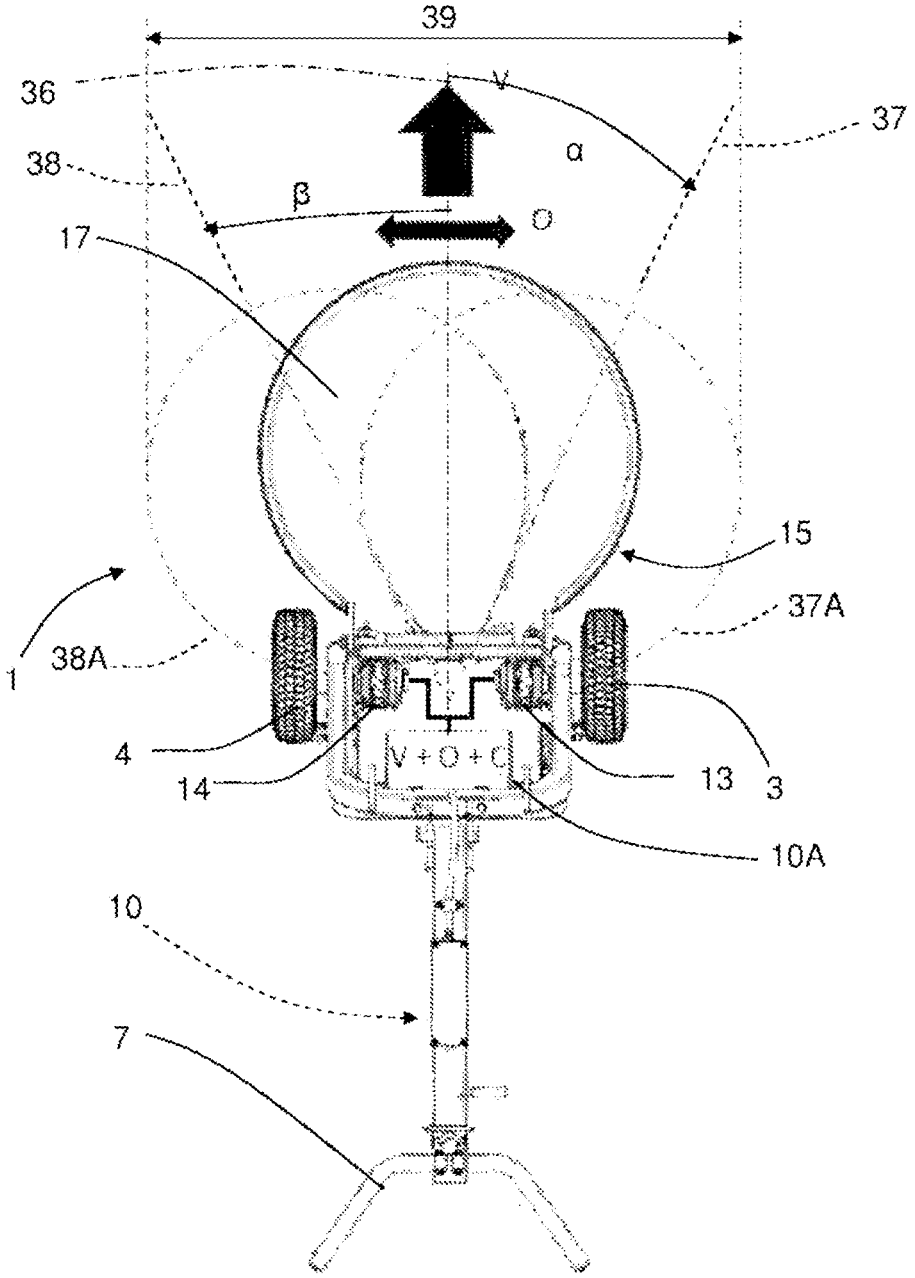
FIG. 7 shows a bottom view of a floor surfacing machine with an oscillating feature.

In one embodiment, the oscillation is achieved by adding an oscillation control signal O to the wheel drive control signal V to be provided to the wheel drive motors/assembly. In FIG. 7, two directional arrows (bold) indicate the movement corresponding to the control signals V and O. The wheel drive control signal V corresponds to the controls given through the remote control panel 11 or the control panel 9. The oscillation control signal O corresponds to the oscillation only.

In FIG. 7, the addition of the oscillation control signal O to the wheel drive control signal V is shown schematically with reference number 10A.

Figure 8:
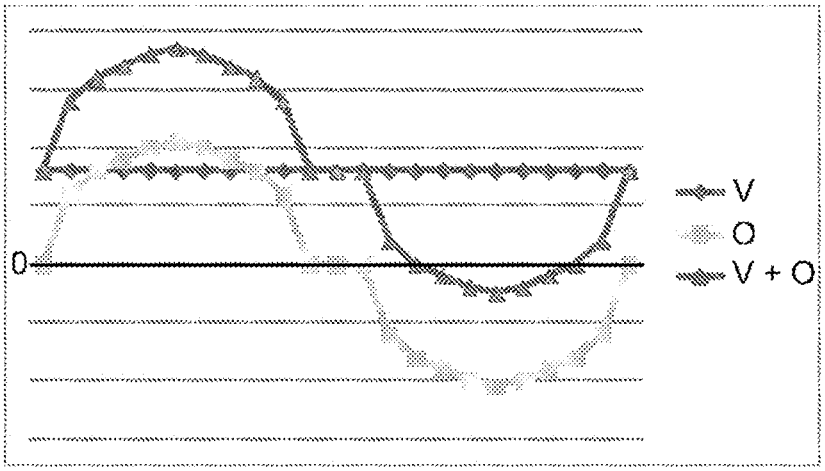
FIG. 8 shows a schematic view of control signals provided to a wheel drive assembly for providing an oscillating feature.
Figure 8:
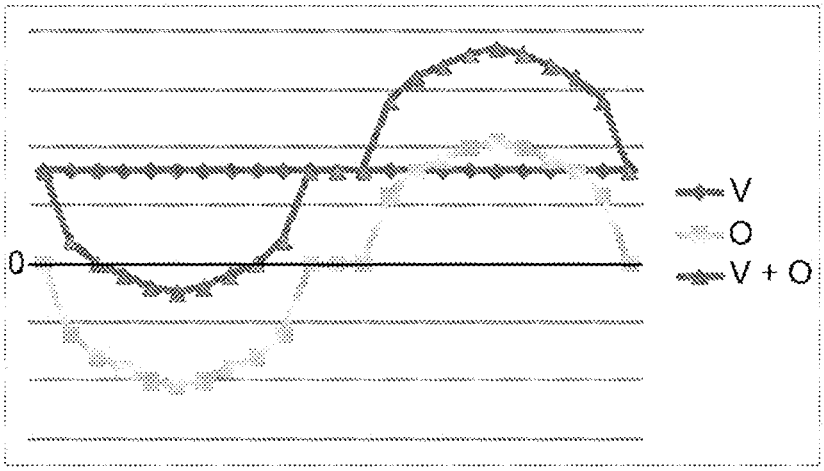

FIG. 8 shows, schematically, examples of the oscillation control signals O and the wheel drive control signals V for both the left 3 and the right wheel 4.

In this example, the wheel drive control signal V indicates a straight movement forwards at a constant speed, which is indicated by the wheel drive control signal being constant.

In this example, the oscillation control signal O indicates an even oscillation between left and right (not accounting for the planetary head's propulsion's contribution), which is indicated by the oscillation control signal being symmetric with regards to the zero-level 0 and that the oscillation control signal for one wheel equals a negated oscillation control signal for the other wheel. The zero level 0 indicates a movement forwards or backwards for a corresponding wheel.

As can be seen, as the oscillation control signal O is added to the wheel drive control signal V which for the left wheel 3 (LEFT) results in a control signal V+O indicating an increase in speed followed by a decrease in speed, even comprising a portion wherein the wheel is reversed, and for the right wheel 4 (RIGHT) results in a control signal V+O indicating a decrease in speed, even comprising a portion wherein the wheel is reversed, followed by an increase in speed. This will result in an oscillation first to the left and then to the right.

In this example, both wheels are controlled individually. In other examples only one wheel may be controlled to oscillate the floor surfacing machine.

Controlling both wheels provides for a tighter or shorter oscillation radius.

As has been discussed in the above, the wheels may be controlled by changing the rotation speed of the wheel by changing the power of the driving motor or by braking one wheel.

Controlling both wheels and allowing for one wheel to be reversed enables for a tighter or shorter oscillation radius, but put some strain on the gearbox (not shown). As seen in FIG. 8, the wheels will reverse for a short period of time when the oscillation signal is negative (the portion indicated by the sum signal V+O being negative).

To reduce the effect on the gear box, and also to provide for a smoother motion, the control unit is arranged to provide an oscillation that has a soft transition from positive values to negative values, as is shown in FIG. 8 by the oscillation signal O having a zero level portion between the positive and the negative portions, the lobes.

Furthermore, the control unit is arranged to provide an oscillation signal which ramps up (and down) faster than a normal sinus signal in order to spend less time in the outermost positions.

In one embodiment the control unit is arranged to generate the oscillation control signal based on a wave shaping function.

In one embodiment the control unit is arranged to generate the oscillation control signal based on a tapered windowing function.

In one embodiment the control unit is arranged to generate the oscillation control signal based on a Planck-tapered windowing function.

In one embodiment the control unit is arranged to generate the oscillation control signal based on a Tukey windowing function. The constant a is in one embodiment in the range 0.25 to 0.75. In one embodiment the constant a is 0.5.

Such functions provide for a smoother operation and reduces the wear on any mechanical parts.

In one embodiment the oscillation control signal comprises zero portions between the lobes.

Having a smooth oscillation signal, as opposed to a square wave signal, provides for a smoother oscillation.

The first angle $\alpha$ and the second angle $\beta$, which angles $\alpha$, $\beta$ may be equal, but may also differ, are adjustable, as well as the oscillating rate. The adjustment may of course be made by means of the remote control panel 11.

Adjusting either of the first and second angles, affects the outermost positions, and thereby affects the surfacing width 39.

The adjustment may also be made by the control unit 10 for compensating for an uneven surface. In one example, the control unit 10 is arranged to determine that the operating surface on one side, for example the right, requires more work as the surface there is more uneven than on the left side, that is the right and left side present uneven surfacing conditions. This may be determined by for example noting the power consumption or the rotation speed of the planetary head 15 (and the satellite heads 19, 20, 21) as it oscillates, for example by monitoring the power consumption of the respective motors 6, 22. If it is determined that one side, for example the right, has a more uneven surface, the adjustment may be to adjust the oscillating frequency so that the floor surfacing machine spends more time on the right side and/or to adjust the angles so that the floor surfacing machine turns more to that side, in this example the right which can be achieved by increasing the first angle $\alpha$ and/or decreasing the second angle $\beta$. Such adjustment may be performed dynamically.

The adjustment may also be made by the control unit 10 for compensating for wheel spin, especially on wet or slippery surfaces. In such a case, the control unit may be arranged to determine that a wheel is rotating at a higher than expected rate. This may be based on a wheel speed sensor (not shown) or a wheel turn sensor (not shown). If it is determined that a wheel is spinning, the control unit 10 may be compensate by reducing the speed of the spinning wheel and at the same time reducing the speed for the other wheel (or increasing if the other wheel is rotating in a different direction).

If possible to determine angle or heading of planetary head, and position of satellites it is possible to determine how to adjust control signal for a smoother operation where the wheel drive units would take into account the propelling contribution provided by the satellite heads 19,20,21 and the planetary head 15. For example, if the planetary head and the satellite heads provide for a contribution resulting in a leftwards rotation, the oscillation should be compensated so that the wheel drive motors drive harder to the right (to compensate for the leftwards rotation provided by the satellite heads 19,20,21 and the planetary head 15) and softer to the left (to cooperate with the leftwards rotation provided by the satellite heads 19,20,21 and the planetary head 15).

If the position of planetary head 15, and/or the position of satellites 19, 20, 21 are known, it is possible to control, in terms of neutralization/cancellation or amplification of, the self-oscillation of the machine that originates from the rotational motion of the planetary head and satellites.

By cancelling or amplifying the self-oscillation provides for a steadier/smoother control of the machine and its oscillation which results in a more even floor (better grinding result).

The current direction of the planetary head may be determined based on counting wheel turns, and the position of the satellite heads may be determined by counting revolutions of the planetary head 15. Alternatively or additionally the direction of the planetary head 15 and/or the position of the satellite heads 19, 20, 21 may be determine through the use of position sensors.

Sensors may be located on the planetary head 15 and satellite disc motors.

Alternatively or additionally, sensor-less position estimation in the electrical motor drive unit for the planetary head and satellite heads are used.

An adjustment may be achieved by adjusting the oscillation control signal O, or by adding a compensation control signal C to the control signal to be sent to the wheel drive motors 13, 14. In FIG. 7, the addition of the compensation signal C to the oscillation control signal O and the wheel drive control signal V is shown schematically with reference number 10A.

The oscillating feature may also be provided for other floor surfacing or treating machines having an operating head and is not limited to floor surfacing machines such as floor grinding machines. Other floor treating machines may be floor cleaning machines and vacuum floor cleaning machines, having operating heads for cleaning and vacuuming respectively.

The invention is not limited to the above, but may vary freely within the scope of the dependent claims. For example, the satellite heads may be arranged for any suitable type of surfacing; being equipped for grinding or polishing. The number of satellite heads may vary, but there should be at least one. The number of wheels 3, 4 may vary, but there are at least two wheels.

The invention claimed is:

1. A floor surfacing machine comprising:

a frame carried by a first wheel and a second wheel, the first wheel configured to be driven by a first wheel drive motor and the second wheel configured to be driven by a second wheel drive motor;

a first motor and a second motor carried by the frame;

a handle arrangement carried by the frame;

a planetary head rotatably mounted to the frame and configured to be driven by the first motor;

at least one satellite surfacing head rotatably mounted to the planetary head and configured to be driven by the second motor and treat a floor surface;

a first control unit coupled to a portion of the floor surfacing machine and configured to enable independent operation of each of the planetary head, the at least one satellite surfacing head, the first wheel, and the second wheel; and a remote control panel configured to enable an operator to independently operate each of the planetary head, the at least one satellite surfacing head, the first wheel, and the second wheel remotely, the remote control panel comprising a second control unit configured to communicate with the first control unit to enable remote, independent control of each of the planetary head, the at least one satellite surfacing head, the first wheel, and the second wheel.

2. A floor surfacing machine according to claim 1, wherein the first control unit is disposed on the handle arrangement.

3. A floor surfacing machine according to claim 1, wherein the second motor is configured to drive the at least one satellite surfacing head via a power-transmitting endless belt.

4. A floor surfacing machine according to claim 1, wherein the first motor is configured to drive the planetary head via at least one cog-wheel configured to engage a driving chain arrangement, the driving chain arrangement being attached to the planetary head.

5. A floor surfacing machine according to claim 1, wherein the planetary head is arranged to be laterally displaced between a leftmost position and a rightmost position in an oscillating manner.

6. A floor surfacing machine according to claim 1, wherein the frame comprises a motor mounting plate onto which the second motor is mounted.

7. A floor surfacing machine according to claim 1, wherein the second motor is connected to a first motor axis extending through a top plate and a bottom plate of the planetary head, the first motor axis being connected to a first belt pulley of the planetary head, wherein in response to the second motor driving the first belt pulley via the first motor axis, the first belt pulley is arranged to drive a power-transmitting endless belt disposed around a portion of an exterior surface of the at least one satellite surfacing head thereby rotating the at least one satellite surfacing head.

8. A floor surfacing machine according to claim 7, wherein the planetary head further comprises a second belt pulley, wherein the second belt pulley is rotatably connected to the bottom plate of the planetary head and is arranged to guide the power-transmitting endless belt around the portion of the exterior surface of the at least one satellite surfacing head.

9. A floor surfacing machine according to claim 8, wherein the planetary head further comprises a tensioning device, wherein the tensioning device is configured to tension the second belt pulley against the power-transmitting endless belt with a predefined force.

10. A floor surfacing machine according to claim 1, wherein the planetary head comprises a driving chain arrangement arranged around a circumference of an exterior rim of the planetary head.

11. A floor surfacing machine according to claim 10, wherein the first motor is connected to a gear-box of the floor surfacing machine, the gear-box comprising a second motor axis, wherein a first cog-wheel and a second cog-wheel are attached to the second motor axis, wherein in response to the first motor driving the first and second cog-wheel via the second motor axis, the first and second cog-wheel are configured to engage the driving chain arrangement thereby rotating the planetary head.

12. A floor surfacing machine according to claim 1, wherein the floor surfacing machine is a floor grinding machine or a floor polishing machine.

* * * * *